United States Patent [19]

Canaris et al.

[11] 4,135,991

[45] Jan. 23, 1979

[54] BATH AND METHOD FOR ELECTROPLATING TIN AND/OR LEAD

[75] Inventors: Valerie M. Canaris, Parma; William J. Willis, Kent, both of Ohio

[73] Assignee: R. O. Hull & Company, Inc., Cleveland, Ohio

[21] Appl. No.: 824,043

[22] Filed: Aug. 12, 1977

[51] Int. Cl.[2] ..... C25D 3/32; C25D 3/36; C25D 3/60

[52] U.S. Cl. ..... 204/43 S; 204/DIG. 2; 204/53; 204/54 R

[58] Field of Search ..... 204/43 S, 53, 54 R, 204/DIG. 2

[56] References Cited

U.S. PATENT DOCUMENTS

| | | | |
|---|---|---|---|
| 3,616,306 | 10/1971 | Conoby et al. | 204/54 R |
| 3,749,649 | 7/1973 | Valayil | 204/43 S |
| 3,769,182 | 10/1973 | Hsu | 204/43 S |
| 3,785,939 | 1/1974 | Hsu | 204/43 S |
| 3,875,029 | 4/1975 | Rosenberg et al. | 204/43 S |
| 3,954,573 | 5/1976 | Dahlgren et al. | 204/43 S |
| 4,000,047 | 12/1976 | Ostrowet al. | 204/43 S |
| 4,049,510 | 9/1977 | Rosenberg | 204/55 R |

*Primary Examiner*—G. L. Kaplan
*Attorney, Agent, or Firm*—Maky, Renner, Otto & Boisselle

[57] ABSTRACT

An aqueous acid plating bath for electrodeposition of tin, lead or tin-lead alloys on a substrate is described and comprises at least one metal salt selected from the group consisting of a stannous salt, a lead salt or a mixture of stannous and lead salts, and as a brightener agent, an effective amount of at least one alkoxylated amine of the formula

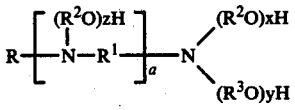

(I)

wherein

R is a fatty acid alkyl group containing from about 8 to about 22 carbon atoms, $R^1$ is an alkylene radical containing up to about 5 carbon atoms, $R^2$ and $R^3$ are each independently an ethylene or propylene group, a is 0 or 1, and x, y and z are each independently integers from 1 to about 30, and the sum of x, y, and z is an integer of from about 2 to about 50.

Methods for the electrodeposition of tin, lead, or tin-lead alloys from such baths as well as additive compositions for forming the baths also are described.

37 Claims, No Drawings

BATH AND METHOD FOR ELECTROPLATING TIN AND/OR LEAD

BACKGROUND OF THE INVENTION

This invention relates to the electrodeposition of tin, lead, and tin-lead alloys, and particularly to a plating bath for depositing smooth, level and bright tin and/or lead coatings. More particularly, the invention relates to aqueous acid plating baths for electrodepositing tin, lead, or tin-lead alloys which contain as a brightener agent, an effective amount of at least one alkoxylated amine as defined hereinafter.

Aqueous acidic plating baths for depositing tin and/or lead coatings have been known in the art, and most of these baths contain, in addition to the water-soluble tin and/or lead salts, at least one radical selected from the group consisting of fluoborates, fluosilicates, sulfamates, etc. In addition to these basic ingredients, the prior art has suggested improvements in such baths by including additives which will improve the brightness of the deposit obtained from such baths. In U.S. Pat. No. 3,875,029, the use of a naphthalene monocarboxaldehyde either alone or in combination with certain substituted olefins described in the patent results in an improvement in the brightness of the deposit. Other ingredients which have been suggested as being useful additives in tin and/or lead plating baths include various combinations of aldehydes, ketones, nonionic surfactants, and amines. For example, U.S. Pat. No. 3,769,182 describes the advantage of utilizing an alkoxylated fatty acid alkylolamide surfactant in tin and/or lead plating baths, and U.S. Pat. No. 3,749,649 describes the advantages of utilizing tin-lead plating baths containing at least one polyether surfactant and at least one aromatic aldehyde containing a chloro substituent. Another bath for producing bright deposits of tin-lead alloys is described in U.S. Pat. No. 3,785,939, and the brightener system comprises a combination of a nonionic polyoxyalkylated surfactant, a lower aliphatic aldehyde, an aromatic aldehyde, and an amine.

SUMMARY OF THE INVENTION

It now has been found that a smooth, level and bright deposit of tin, lead or tin-lead alloy can be deposited on a substrate from an aqueous acid plating bath comprising at least one metal salt selected from the group consisting of a stannous salt, a lead salt, or a mixture of stannous and lead salts, and as a brightener agent an effective amount of at least one alkoxylated amine of the formula

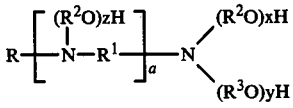

(I)

wherein

R is a fatty acid alkyl group containing from about 8 to about 22 carbon atoms, $R^1$ is an alkylene radical containing up to about 5 carbon atoms, $R^2$ and $R^3$ are each independently an ethylene or propylene group, a is 0 or 1, and x, y and z are each independently integers from 1 to about 30, and the sum of x, y, and z is an integer of from about 2 to about 50.

In addition, the aqueous acid plating bath of the invention also may contain at least one radical selected from the group consisting of fluoborates, fluoscilicates, sulfamates, or mixtures thereof, aliphatic and/or aromatic aldehydes and aromatic amines. When the above-described brightener agents are utilized in the above-described plating baths, the tin and/or lead deposited from said bath is smooth and bright.

DESCRIPTION OF THE PREFERRED EMBODIMENTS

The compositions of the invention which are particularly useful as brightener agents for aqueous acid tin, lead, or tin-lead plating baths are alkoxylated amines of the formula

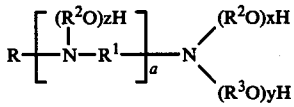

(I)

wherein

R is a fatty acid alkyl group containing from about 8 to about 22 carbon atoms, $R^1$ is an alkylene radical containing up to about 5 carbon atoms, $R^2$ and $R^3$ are each independently an ethylene or propylene group, a is 0 or 1, and x, y and z are each independently integers from 1 to about 30, and the sum of x, y, and z is an integer of from about 2 to about 50.

More particularly, the alkoxylated amines utilized as brighteners in the baths of the invention are represented by the formulas II and III

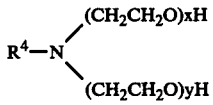

(II)

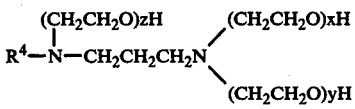

(III)

wherein $R^4$ is a fatty acid alkyl group containing from 12 to 18 carbon atoms, and x, y and z are as defined in formula I.

The above described brighteners are known in the art as cationic surfactants and are available from a variety of commercial sources. The brighteners are of the type represented by formula II can be prepared by condensing various amounts of ethylene oxide with primary fatty amines which may be a single amine or a mixture of amines such as are obtained by the hydrolysis of tallow oils, sperm oils, coconut oils, etc. Specific examples of fatty acid amines containing from eight to 22 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The alkoxylated amines which are useful as brighteners in the plating baths of the invention can be prepared, as mentioned above, by condensing alkylene oxides with the above-described primary amines by techniques known to those in the art. A number of such alkoxylated amines is commercially available from a variety of sources. The alkoxylated amines of the type represented by formula II are available from the Armak Chemical Division of Akzona, Inc., Chicago, Ill., under the general trade designation "Ethomeen." Specific examples of such products include "Ethomeen C/15" which is an ethylene oxide condensate of a coconut fatty acid containing about 5 moles of ethylene oxide; "Ethomeen C/20" and "C/25" which also are ethylene oxide condensation products from coconut fatty acid containing about 10 and 15 moles of ethylene oxide respectively; "Ethomeen S/15" and "S/20" which are ethylene oxide condensation products with stearyl amine containing about 5 and 10 moles of ethylene oxide per mole of amine respectively; and "Ethomeen T/15" and "T/25" which are ethylene oxide condensation products of tallow amine containing about 5 and 15 moles of ethylene oxide per mole of amine respectively. Commercially available examples of the alkoxylated amines of the type represented by formula III include "Ethoduomeen T/13" and "T/20" which are ethylene oxide condensation products of N-tallow trimethylene diamine containing about 3 and 10 moles of ethylene oxide per mole of diamine respectively.

The above-identified alkoxylated amines represented by formulas I, II and III are effective brightener agents in otherwise conventional aqueous acid tin, lead, or tin-lead plating baths. Such baths contain water-soluble stannous salts, water-soluble lead salts, or mixtures thereof, depending upon the metal or metals to be deposited by the bath on a substrate, and a radical selected from the group consisting of fluoborates, fluosilicates, sulfamates and mixtures thereof. The amount of metal ion or ions in the bath may vary over a wide range depending upon the desired properties of the plating to be deposited on the substrate. Generally, from about five to about 350 grams per liter or more of the metal ion or ions, and from about 50 to about 500 grams per liter of the above-defined radicals will be included in the plating baths of the invention. Obviously, when a tin deposit is desired, the lead ion should be omitted from the bath, and, conversely, when a lead deposit is desired, the stannous ion is omitted from the bath. The aqueous acid plating baths of the invention are maintained at a pH of less than about three.

The aqueous acid plating baths of the invention may be utilized to produce tin, lead, or tin-lead deposits on all types of metals and alloys, for example, on iron, copper and brass, and the brightener agents described above may be added to such plating baths employed in all types of industrial plating processes including still plating baths, high-speed plating baths for strip or wire plating, and in barrel plating.

The amount of the above-described alkoxylated amine brightener which is added to the acid plating baths of the invention is an amount which is sufficient to produce a smooth and bright tin, lead, or tin-lead deposit on the substrate, and generally in a range from about one to about 50 grams per liter and preferably from about one to about 30 grams per liter of bath.

The properties of the tin and/or lead deposited by the baths of the invention may be enhanced further by including other additives in the bath. Preferably, the plating baths of the invention will contain at least one aldehyde which may be an aliphatic aldehyde, an aromatic aldehyde, or mixtures of such aldehydes. The aliphatic aldehydes which are particularly useful in the plating baths of the invention are those containing up to about four carbon atoms and these include, for example, formaldehyde, acetaldehyde, propionaldehyde, butyraldehyde, crotonaldehyde, and 3-hydroxy-butanal. Up to about 25 grams per liter of the aliphatic aldehyde may be included in the baths and preferably, from about one to about 25 grams per liter of the aliphatic aldehyde is utilized.

Preferred examples of the aromatic aldehydes which have been found useful are the naphthaldehydes and benzaldehydes. It is preferred that the benzaldehydes contain at least one chloro substituent. Examples of aromatic aldehydes which may be utilized in the plating baths of the invention include o-chlorobenzaldehyde; 2,4-dichlorobenzaldehyde; 3,4-dichlorobenzaldehyde; 3,5-dichlorobenzaldehyde; 2,6-dichlorobenzaldehyde; tolualdehyde; 3,4-dimethoxybenzaldehyde; cinnamaldehyde; and anisaldehyde. Examples of the naphthaldehydes include 1-naphthaldehyde; 2-naphthaldehyde; 2-methoxy-1-naphthaldehyde; 2-hydroxy-1-naphthaldehyde; 2-ethoxy-1-naphthaldehyde; 4-methoxy-1-naphthaldehyde; 4-ethoxy-1-naphthaldehyde; and 4-hydroxy-1-naphthaldehyde. In some applications, a combination of the naphthaldehyde with a benzaldehyde such as 1-naphthaldehyde with 2,6-dichlorobenzaldehyde provides a superior deposit on the substrates. Other carbonyl containing compounds can be used in the baths of the invention either in place of the aromatic aldehydes or combination therewith and these include 3-indole carboxaldehyde; 2-thiophene carboxaldehyde; and benzylidene acetone. The amount of aromatic aldehyde or other carbonyl containing compound included in the baths of the invention will range up to about ten grams per liter of bath and preferably is from about 0.05 to about ten grams per liter of bath.

Mixtures of aliphatic aldehydes and the above-described aromatic aldehydes, and mixtures of naphthaldehydes and benzaldehydes have been found to be particularly useful. Examples of suitable combinations include: the mixture of acetaldehyde and 4-methoxy-1-naphthaldehyde; the mixture of formaldehyde, 1-naphthaldehyde, and 2,6-dichlorobenzaldehyde; etc.

The properties of the tin and/or lead deposits obtained from the baths of the invention also may be improved in some instances by the inclusion of an aromatic amine in the bath, and the bath may contain up to about 15 grams of aromatic amine per liter of bath and generally will contain from about one to about 15 grams of aromatic amine per liter of bath. Examples of aromatic amines which are useful include o-toluidine; p-toluidine; m-toluidine; aniline; and o-chloroaniline.

The baths of the invention also may contain a small amount of one or more chlorinated benzenes such as 1,2-dichlorobenzene; 1,2,4-trichlorobenzene; 1,2,3-trichlorobenzene and 1,3,5-trichlorobenzene. Amounts up to about five grams of the chlorinated benzene per liter of bath, and preferably from about 0.5 to about three grams per liter, may be utilized.

The acid tin, lead, and tin-lead plating baths of the present invention deposit a level coating of the metal or alloy on substrates at any conventional temperatures used with tin and/or lead plating baths, and over a wide current density range such as from two to 2000 amperes per square foot (ASF).

The following examples illustrate the plating baths of the invention containing the alkoxylated amine brightener agents. Unless indicated, all parts and percentages are by weight. The utility of the baths is demonstrated by plating steel Hull panels in a 267 ml. Hull cell. Current densities are measured with a Hull cell scale, and the solutions are agitated mechanically.

EXAMPLE 1

An aqueous acid plating bath is prepared by mixing sufficient quantities of stannous and lead fluoborate, fluoborate acid, and boric acid in water to provide a bath containing about 13 g/l of stannous ion, about 5 g/l of lead ion, about 120 g/l of free fluoboric acid and about 10 g/l boric acid. The bath also contains as a brightener system about 6 g/l of Ethomeen C/20, about 0.8 ml./l of acetaldehyde, and about 0.14 g/l of 4-methoxy-1-naphthaldehyde. This bath deposited a 60/40 plate which was bright but mottled over a current density range of from 6 to about 120 ASF.

EXAMPLE 2

An aqueous acidic plating bath is prepared containing about 50 g/l stannous ion, about 25 g/l lead ion, about 140 g/l fluoboric acid and about 30 g/l boric acid. Also contained in the bath of this example is about 12 g/l of Ethomeen S/20, about 1.5 ml/l of aniline, about 1 g/l of 1,2,4-trichlorobenzene, about 0.2 g/l of 1-naphthaldehyde, about 0.05 g/l of 2,6-dichlorobenzaldehyde and about 30 ml/l of 37% aqueous formaldehyde. This bath produces a 60/40 tin lead alloy at a current density of about 40 ASF. This bath produces a bright deposit for both rack and barrel applications.

EXAMPLE 3

The bath of this invention contains about 50 g/l of stannous ion, about 50 g/l of lead ion, about 150 g/l of free fluoboric acid, and about 35 g/l of boric acid. The bath also contains a brightener system comprising about 15 g/l of Ethomeen S/20, about 2/5 ml/l of o-toluidine, about 1 g/l of 1,2,4-trichlorobenzene, about 0.18 g/l of 1-naphthaldehyde, about 0.16 g/l of 2,6-dichlorobenzandehyde, and about 15 ml/l of formalin. This bath produces a brilliant deposit of a 40/60 tin lead alloy at about 30 ASF.

EXAMPLE 4

A bath is prepared similar to the bath prepared in Example 3 except that the Ethomeen S/20 is replaced by an equivalent amount of Ethomeen T/15.

EXAMPLE 5

An aqueous plating bath is prepared by mixing water with sufficient quantities of stannous fluoborate, fluoboric acid and boric acid to provide about 75 g/l of stannous ion, about 140 g/l of fluoboric acid, and about 10 g/l of boric acid. The bath also contains as a brightener system, about 15 g/l of Ethomeen T/15, about 2.2 ml/l of 0-chloro-aniline, about 0.15 g/l of 2,6-dichlorobenzaldehyde, about 1 g/l of 1,2,4-trichlorobenzene and about 15 ml/l of 37% aqueous formaldehyde. This bath produces a semi-bright tin deposit and may be used for both rack and barrel applications.

EXAMPLE 6

An aqueous plating bath is prepared by mixing with water sufficient quantities of stannous and lead fluoborate, fluoboric acid and boric acid to provide about 30 g/l of stannous ion, about 3.0 g/l of lead ion, about 225 g/l of free fluoboric acid and about 30 g/l of boric acid. The brightener system which is incorporated into the bath comprises about 6.0 g/l Ethomeen 18/20 (an ethylene oxide condensation product of stearyl amine containing about 10 moles of ethylene oxide; available from Armak Company), about 0.5 g/l of 1,2,4-trichlorobenzene, about 2.25 g/l of o-toluidine, about 0.2 g/l of benzylidine acetone and about 15 ml/l of formalin solution.

A steel panel is plated in a Hull cell at 2 amperes for 5 minutes and the bath produces a brilliant level deposit of from about 10 to well over 80 ASF. The alloy of the deposit is 90/10 tin-lead.

EXAMPLE 7

The procedure of Example 6 is repeated except that the Ethomeen 18/20 is replaced by an equivalent amount of Ethoduomeen T/13.

EXAMPLE 8

An aqueous plating bath is prepared by mixing sufficient quantities of lead fluoborate, fluoboric acid and boric acid in water to provide about 160 g/l of lead ion, about 10 g/l of free fluoboric acid and about 15 g/l of boric acid. Sufficient Ethomeen S/20 is added to the bath to provide a concentration of about 15 g/l.

A steel panel was plated in a Hull cell at 2 amperes for 5 minutes, and the bath gave a smooth lead deposit which exhibits a slight sheen over a wide current density range of about 2 to about 100 ASF.

In practice, the improved tin, lead, and tin-lead alloy plating baths containing the brightener agents of the invention may be operated on a continuous or intermittent basis, and from time to time, components of the bath have to be replenished. The various components may be added singularly as required or may be added in combination. The amounts of the various additive compositions to be added to the plating baths may be varied over a wide range depending on the nature and performance of the plating bath to which the composition is added. Such amounts can be determined readily by one skilled in the art.

Another aspect of this invention relates to additive compositions which may be mixtures of the compositions without any solvent or carrier, or they may be concentrates of bath components in water, alcohols (e.g., propanol) or mixtures of water and one or more alcohols. The additive composition will comprise at least one brightener according to formula I, and at least one aldehyde and/or one or more of the additional bath components described above such as the chlorinated benzenes. The amounts of the compounds in the various additive compositions or concentrates of the invention will be such that when they are diluted, they will provide the requisite amounts of the components in the bath or the requisite amounts of the components to replenish the bath.

The following additive compositions or concentrates illustrate the various combinations or compounds that may be prepared and utilized in accordance with the invention for preparing and/or maintaining the baths of the invention, and/or improving the performance of the baths of the invention. Other additives may be added individually or in other combinations to the baths.

| Additive Composition 1 | Parts by Weight |
|---|---|
| Ethomeen C/15 | 6.0 |
| 4-methoxy-1-naphthaldehyde | 0.14 |
| Additive Composition 2 | |
| Ethomeen S/20 | 12 |

-continued

| Additive Composition 1 | Parts by Weight |
|---|---|
| 1-naphthaldehyde | 0.2 |
| Additive Composition 3 | |
| Ethomeen S/20 | 12 |
| 1-naphthaldehyde | 0.2 |
| 2,6-dichlorobenzaldehyde | 0.05 |
| 1,2,4-trichlorobenzene | 1.0 |
| Additive Composition 4 | |
| Ethomeen T/25 | 15 |
| 2,6-dichlorobenzaldehyde | 0.2 |

We claim:

1. An aqueous acid plating bath for electrodeposition of tin, lead or tin-lead alloys comprising at least one bath-soluble metal salt selected from the group consisting of a stannous salt, a lead salt or a mixture of stannous and lead salts, and as a brightener agent, an effective amount of (a) at least one alkoxylated amine of the formula

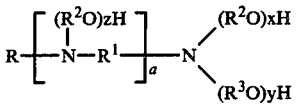

(I)

wherein

R is a fatty acid alkyl group containing from about 8 to about 22 carbon atoms, $R^1$ is an alkylene radical containing up to about 5 carbon atoms, $R^2$ and $R^3$ are each independently an ethylene or propylene group, a is 0 or 1, and x, y and z are each independently integers from 1 to about 30, and the sum of x, y and z is an integer of from about 2 to about 50., and (b) an aromatic amine selected from the group consisting of aniline, o-toluidine, m-toluidine, p-toluidine or o-chloroaniline.

2. The plating bath of claim 1 wherein the bath comprises a mixture of stannous and lead ions and at least one radical selected from the group consisting of fluoborates, fluosilicates, sulfamates or mixtures thereof.

3. The plating bath of claim 2 wherein the bath contains a mixture of boric acid and fluoboric acid.

4. The plating bath of claim 1 wherein a is zero and $R^2$ and $R^3$ are ethylene groups.

5. The plating bath of claim 1 wherein a is one and $R^1$ is a propylene group.

6. The plating bath of claim 1 wherein the brightener comprises a mixture of at least one alkoxylated amine, an aromatic amine and at least one aldehyde compound.

7. The plating bath of claim 6 wherein the aldehyde compound is an aliphatic aldehyde containing up to about four carbon atoms.

8. The plating bath of claim 7 wherein the aliphatic aldehyde is formaldehyde.

9. The plating bath of claim 6 wherein the aldehyde is an aromatic aldehyde.

10. The plating bath of claim 9 wherein the aromatic aldehyde is a 1-naphthaldehyde.

11. The plating bath of claim 9 wherein the aromatic aldehyde contains at least one chloro substituent.

12. The plating bath of claim 11 wherein the aromatic aldehyde is a chlorobenzaldehyde.

13. The plating bath of claim 12 wherein the benzaldehyde is a dichlorobenzaldehyde.

14. The plating of claim 6 wherein the aldehyde is a mixture of an aromatic aldehyde and an aliphatic aldehyde.

15. An aqueous acid plating bath for electrodeposition of a tin, lead or tin-lead alloy comprising from about 5 to about 350 grams per liter of at least one metal ion selected from the group consisting of stannous ion, lead ion and mixtures thereof, from about 50 to about 500 grams per liter of at least one radical selected from the group consisting of fluoborates, fluosilicates, sulfamates, and mixtures thereof, and as a brightener composition, (a) from about 1 to about 30 grams per liter of at least one alkoxylated amine of the formula

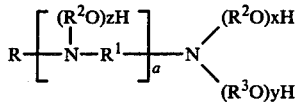

(I)

wherein

R is a fatty acid alkyl group containing from about 8 to about 22 carbon atoms, $R^1$ is an alkylene radical containing up to about 5 carbon atoms, $R^2$ and $R^3$ are each independently an ethylene or propylene group, a is 0 or 1, and x, y and z are each independently integers from 1 to about 30, and the sum of x, y and z is an integer of from about 2 to about 50, (b) from zero to about 10 grams per liter of at least one aromatic aldehyde, (c) from zero to about 25 grams per liter of an aliphatic aldehyde containing up to about 4 carbon atoms, and (d) from about one to about 15 grams per liter of an aromatic amine selected from the group consisting of aniline, o-toluidine, m-toluidine, p-toluidine or o-chloroaniline.

16. The plating bath of claim 15 wherein the aromatic aldehyde is a 1-naphthaldehyde, a chlorobenzaldehyde or a mixture thereof.

17. The plating bath of claim 15 wherein the aliphatic aldehyde is formaldehyde.

18. The plating bath of claim 15 wherein a is zero, and x and y are ethylene groups in formula (I).

19. The method of electrodepositing tin, lead or tin-lead alloy on a substrate which comprises electroplating said substrate with an aqueous acid plating bath which comprises at least one metal salt selected from the group consisting of a stannous salt, a lead salt or a mixture of stannous and lead salts, and as a brightener agent, an effective amount of (a) at least one alkoxylated amine of the formula

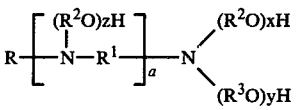

(I)

wherein

R is a fatty acid alkyl group containing from about 8 to about 22 carbon atoms, $R^1$ is an alkylene radical containing up to about 5 carbon atoms, $R^2$ and $R^3$ are each independently integers from 1 to about 30, and the sum of x, y and z is an integer of from about 2 to about 50, and (b) an aromatic amine selected from the group consisting of aniline, o-toluidine, m-toluidine, p-toluidine or o-chloroaniline.

20. The method of claim 19 wherein the bath comprises a mixture of stannous and lead ions and at least one radical selected from the group consisting of fluoborates, fluosilicates, sulfamates or mixtures thereof.

21. The method of claim 20 wherein the bath contains a mixture of boric acid and fluoboric acid.

22. The method of claim 19 wherein a is zero and $R^2$ and $R^3$ are ethylene groups.

23. The method of claim 19 wherein a is one and $R^1$ is a propylene group.

24. The method of claim 19 wherein the brightener comprises a mixture of at least one alkoxylated amine, an aromatic amine and at least one aldehyde compound.

25. The method of claim 24 wherein the aldehyde compound is an aliphatic aldehyde containing up to about four carbon atoms.

26. The method of claim 25 wherein the aliphatic aldehyde is formaldehyde.

27. The method of claim 24 wherein the aldehyde is an aromatic aldehyde.

28. The method of claim 27 wherein the aromatic aldehyde is a 1-naphthaldehyde.

29. The method of claim 27 wherein the aromatic aldehyde contains at least one chloro substituent.

30. The method of claim 29 wherein the aromatic aldehyde is a chlorobenzaldehyde.

31. The method of claim 30 wherein the benzaldehyde is a dichlorobenzaldehyde.

32. The method of claim 24 wherein the aldehyde is a mixture of an aromatic aldehyde and an aliphatic aldehyde.

33. The method of electrodepositing tin, lead or tin-lead alloy on a substrate which comprises electroplating said substrate with an aqueous acid plating bath comprising from about 5 to about 350 grams per liter of at least one metal ion selected from the group consisting of stannous ion, lead ion and mixtures thereof from about 50 to about 500 grams per liter of at least one radical selected from the group consisting of fluoborates, fluosilicates, sulfamates, and mixtures thereof, and as a brightener composition, (a) from about 1 to about 30 grams per liter of at least one alkoxylated amine of the formula

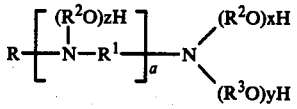

(I)

wherein

R is a fatty acid alkyl group containing from about 8 to about 22 carbon atoms, $R^1$ is an alkylene radical containing up to about 5 carbon atoms, $R^2$ and $R^3$ are each independently an ethylene or propylene group, a is 0 or 1, and x, y and z are each independently integers from 1 to about 30, and the sum of x, y and z is an integer of from about 2 to about 50, (b) from zero to about 10 grams per liter of at least one aromatic aldehyde, (c) from zero to about 25 grams per liter of an aliphatic aldehyde containing up to about four carbon atoms, and (d) from about one to about 15 grams per liter of an aromatic amine selected from the group consisting of aniline o-toluidine, m-toluidine, p-toluidine or o-chloroaniline.

34. The method of claim 33 wherein the aromatic aldehyde is a 1-naphthaldehyde, a chlorobenzaldehyde or a mixture thereof.

35. The method of claim 33 wherein the aliphatic aldehyde is formaldehyde.

36. The method of claim 33 wherein a is zero, and x and y are ethylene groups in formula (I).

37. A brightener additive composition for aqueous acid tin, lead or tin-lead electroplating baths comprising a mixture of:

(a) at least one alkoxylated amine of the formula

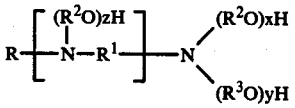

wherein

R is a fatty acid alkyl group containing from about 8 to about 22 carbon atoms, $R^1$ is an alkylene group containing three carbon atoms, $R^2$ and $R^3$ are each independently an ethylene or propylene group, a is 1, and x, y and z are each independently integers from 1 to about 30, and the sum of x, y and z is an integer of from about 2 to about 50, and (b) at least one aromatic aldehyde, at least one of which is a chlorobenzaldehyde.

* * * * *